US009275629B2

(12) United States Patent
Beslin

(10) Patent No.: US 9,275,629 B2
(45) Date of Patent: Mar. 1, 2016

(54) ACOUSTIC PROJECTOR HAVING SYNCHRONIZED ACOUSTIC RADIATORS

(71) Applicant: ULTRA ELECTRONICS MARITIME SYSTEMS INC., Dartmouth (CA)

(72) Inventor: Olivier Beslin, Eastern Passage (CA)

(73) Assignee: ULTRA ELECTRONICS MARITIME SYSTEMS INC., Dartmouth (CA)

( * ) Notice: Subject to any disclaimer, the term of this patent is extended or adjusted under 35 U.S.C. 154(b) by 191 days.

(21) Appl. No.: 14/075,907

(22) Filed: Nov. 8, 2013

(65) Prior Publication Data

US 2014/0064035 A1 Mar. 6, 2014

Related U.S. Application Data

(63) Continuation of application No. PCT/CA2012/050300, filed on May 9, 2012.

(60) Provisional application No. 61/483,966, filed on May 9, 2011.

(51) Int. Cl.
*G10K 11/18* (2006.01)
*G10K 11/02* (2006.01)
(Continued)

(52) U.S. Cl.
CPC ..... *G10K 11/18* (2013.01); *G10K 9/125* (2013.01); *G10K 11/02* (2013.01); *B63B 45/00* (2013.01)

(58) Field of Classification Search
CPC ..... G10K 9/125; G10K 11/18; G10K 11/02; B63B 45/00
See application file for complete search history.

(56) References Cited

U.S. PATENT DOCUMENTS 2,408,435 A * 10/1946 Mason ..... G01S 1/02 333/22 R
3,604,529 A * 9/1971 Fothergill ..... G10K 11/22 367/151

(Continued)

FOREIGN PATENT DOCUMENTS

CA WO 2012151696 A1 * 11/2012 ..... G10K 9/125
KR WO 2008032982 A1 * 3/2008 ..... G01S 7/521

OTHER PUBLICATIONS

International Searching Authority, "International Search Report," issued in connection with application No. PCT/CA2012/050300, mailed on Aug. 3, 2012, 5 pages.

(Continued)

*Primary Examiner* — Daniel Pihulic
(74) *Attorney, Agent, or Firm* — Hanley, Flight & Zimmerman, LLC.

(57) ABSTRACT

A method and system for maximizing radiated power from a linear array of acoustic projectors. In one case, the method realizes omni-directional acoustic beam patterns from a linear array of acoustic projectors contained within an acoustically-impervious enclosure with an acoustically transparent aperture. In another case, the method realizes an efficient set of beams for a conventional horizontal projector array or a similar acoustic projector array, which may be within an acoustically transparent enclosure. Drive signals are determined by finding a mutual impedance matrix that characterizes the interdependence of the acoustic projectors and solving an eigenvalue problem for the mutual impedance matrix. One of the eigenvalues is selected on the basis that it maximizes radiated power, and the corresponding eigenvectors are used to derive the corresponding drive signals.

18 Claims, 20 Drawing Sheets

(51) Int. Cl.
*G10K 9/125* (2006.01)
*B63B 45/00* (2006.01)

(56) References Cited

U.S. PATENT DOCUMENTS 3,786,407 A * 1/1974 Ogawa ..... H04R 17/10 367/159
6,234,765 B1 5/2001 Deak
6,489,707 B1 12/2002 Guerrero
8,064,290 B2 * 11/2011 Ding ..... G06F 3/03545 367/128
8,290,195 B2 * 10/2012 Chick ..... H04R 1/36 181/175
8,324,517 B2 * 12/2012 Conrad ..... G06F 3/03545 367/127
2010/0270091 A1 * 10/2010 Ding ..... G06F 3/03545 178/19.02
2011/0058702 A1 * 3/2011 Saggio, Jr. ..... H04R 1/1016 381/380
2011/0058703 A1 * 3/2011 Saggio, Jr. ..... H04R 1/1016 381/380
2011/0147100 A1 * 6/2011 Conrad ..... G06F 3/043 178/18.01
2011/0243362 A1 * 10/2011 Chick ..... H04R 1/36 381/386
2012/0121119 A1 * 5/2012 Saggio, Jr. ..... H04R 1/1016 381/380
2014/0064035 A1 * 3/2014 Beslin ..... G10K 9/125 367/137

OTHER PUBLICATIONS

International Searching Authority, "Written Opinion of the International Searching Authority," issued in connection with application No. PCT/CA2012/050300, on Jul. 10, 2012, 6 pages.

* cited by examiner $$\left\{ i_{np}^{j\,*} \right\} \left( Z_{nm}^{a} \right) \left\{ i_{mp}^{j} \right\} = \lambda_j \left\{ i_{mp}^{j\,*} \right\} \left\{ i_{mp}^{j} \right\} = \lambda_j$$

- $N$ Eigenvectors $\left\{ i_{mp}^{j} \right\}$, $j = 1$ to $N$
- $N$ Eigenvectors $\left\{ \lambda_j \right\}$, $j = 1$ to $N$

FIG. 3

ACOUSTIC PROJECTOR HAVING SYNCHRONIZED ACOUSTIC RADIATORS

CROSS-REFERENCE TO RELATED APPLICATIONS

This patent is a continuation of PCT Application Serial No. PCT/CA2012/050300, filed May 9, 2012, entitled ACOUSTIC PROJECTOR HAVING SYNCHRONIZED ACOUSTIC RADIATORS, which claims priority to U.S. Provisional Patent Application Ser. No. 61/483,966, filed May 9, 2011, owned in common herewith. PCT Application Serial No. PCT/CA2012/050300 and U.S. Provisional Patent Application Ser. No. 61/483,966 are hereby incorporated herein by reference.

FIELD

The present application generally relates to acoustic projectors, particularly for use in connection with maritime operations.

BACKGROUND

The design of a cost-effective, low-frequency, high power, high efficiency, omnidirectional acoustic projector remains a challenge due to conflicting constraints. For a given cavitation pressure threshold, high power requires a large radiation area while omni-directionality typically requires a projector with a dimension smaller than the third of a wavelength. Accordingly, there is a need for an acoustic projector design that addresses these conflicting requirements.

To achieve omni-directionality, current acoustic projectors (particularly for maritime uses) employ a large, heavy, towed projector, such as a free flooded ring (FFR). Due to the low resonant frequency of operation, despite being approximately up to a meter in diameter, the FFR appears as a point source and produces a substantially omni-directional wave. To achieve longer range, the acoustic projector needs to be driven with a high power signal, but the size and weight of the projector and the localized power intensity (because of the danger of cavitation at the face of the diaphragm) impose limits on the ability to increase the power of the drive signal.

BRIEF DESCRIPTION OF THE DRAWINGS

Reference will now be made, by way of example, to the accompanying drawings which show example embodiments of the present application, and in which:

FIG. 3 shows a method for determining eigenvalues according to an example embodiment;

Similar reference numerals may have been used in different figures to denote similar components.

DESCRIPTION OF EXAMPLE EMBODIMENTS

Figure 1:
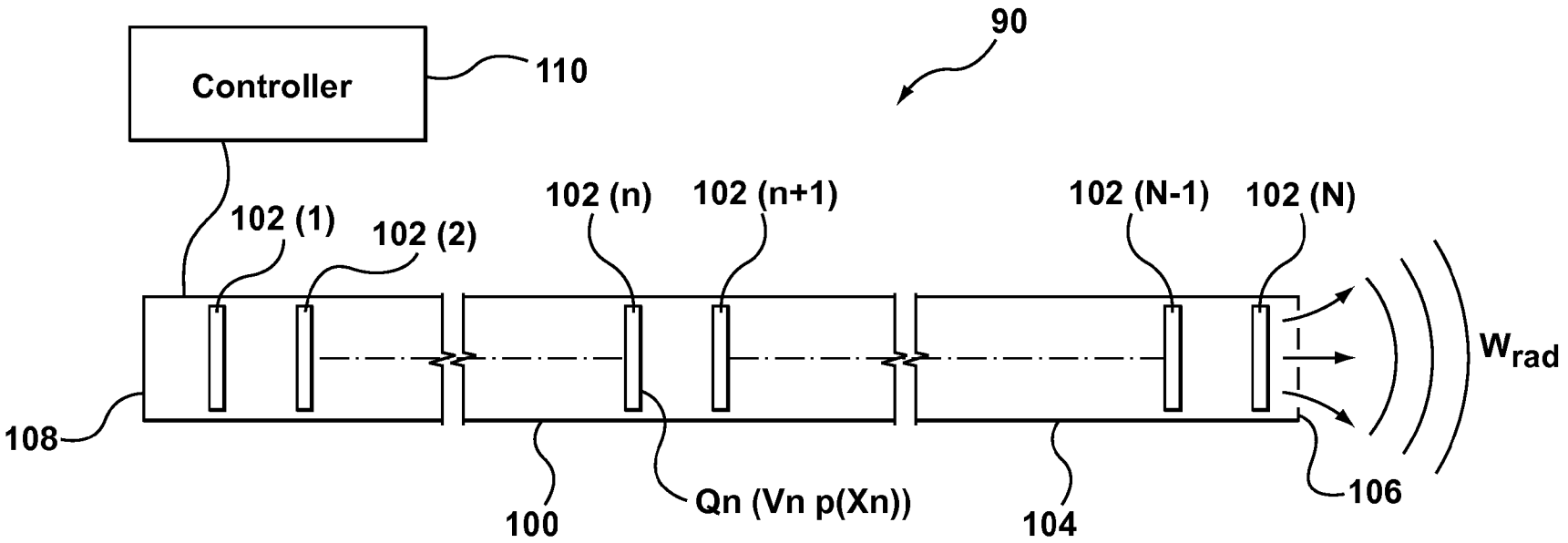
FIG. 1 is a schematic representation of an omnidirectional acoustic projector system according to an example embodiment.

In one aspect, the present application describes an acoustic projector with an operating frequency having a minimum wavelength under operating conditions. The acoustic projector includes an enclosure formed from a substantially acoustically-impervious exterior wall, wherein the exterior wall defines an acoustically transparent aperture smaller than one-third the minimum wavelength; an array of acoustic transducers within the enclosure; and a drive circuit for driving each acoustic transducer in the array with a respective drive signal.

In another aspect, the present application describes a method for controlling an acoustic projector, the acoustic projector including an array of acoustic transducers. The method includes determining a mutual impedance matrix that characterizes the mutual coupling among the acoustic transducers; identifying a set of eigenvalues that solve an eigenvalue problem of the mutual impedance matrix; selecting one of the eigenvalues that maximizes an expression for radiated power; and determining, from the selected one of the eigenvalues, respective driving signals for driving each of the acoustic transducers.

Other aspects and features of the present application will be apparent to those of ordinary skill in the art in light of the following description of example embodiments.

One way of achieving high power without increasing the projector size to unworkable dimensions is to drive a large number of efficient, low cost transducers (like benders developed for the sonobuoys market) in such a way that system efficiency and omni-directionality can be achieved. In example embodiments, a proposed power maximization method fulfills these conflicting requirements.

In an example embodiment, the proposed SASER (Sound Amplification by Synchronized Excitation of Radiators) concept comprises aligning a large number of transducers inside a hard-walled tube and to allow the acoustic energy flow to escape from the tube substantially only through a single aperture (typically at one end of the tube), smaller than one third of the acoustic wavelength in order to create a monopole source. An Eigenvalue-based power maximization method determines an optimum transducer driving voltage distribution (magnitude and phase) to be applied to the system in order to maximize radiated power.

The presented power maximization method is applicable to many systems using transducer arrays like medical imaging and, more generally, structural health monitoring devices. The method may also be applied to electromagnetic antennas and could be applied to RF communications towers, RADAR, magneto-inductive communication and wireless powering systems, and more generally to any system involving multi-channel inputs and/or outputs.

As noted above, the design of a cost effective acoustic projector that achieves the desirable characteristics of low frequency, high power, high efficiency and omni-directionality has remained a challenge due to conflicting restraints. For example, in at least some applications, for a given cavitation pressure threshold, high power requires a large radiation area while omni-directionality requires an acoustic projector dimension smaller than a third of a wavelength. According to example embodiments, relatively high power at relatively low cost is sought by driving a large number of efficient low cost acoustic sources or transducers to optimize efficiency and achieve omni-directionality. Example embodiments described herein are directed to sound projectors that employ a SASER technique.

A horizontal projector array (HPA) uses a series of acoustic transducers (sometimes termed "benders"). The HPA is often implemented by housing the series of acoustic transducers in a flexible sheath. The HPA is deployed from a winch onboard a maritime vessel, with the series of HPA transducers connected to the vessel by a tow line. Cables for supplying driving current to the HPA transducers are connected to a power circuit, typically onboard the vessel.

The HPA generally radiates a non-uniform field. In some cases, beamforming may be used to "sweep" the radiated beam pattern. In general, HPAs, as currently used, are poorly loaded.

The present application describes systems and methods that determine the mutual impedances (or store a determined matrix defining the mutual impedances) and determine optimum sets of currents for driving an array of acoustic transducers. When used with an HPA, the method described herein realizes an efficient set of beams that cover a 360 degree sector. When used with the new acoustic projector described herein, the method results in a substantially omni-directional and efficient beam pattern, despite the fact the new acoustic projector is formed using an array of acoustic transducers.

In this regard, FIG. 1 illustrates a model of an acoustic projector system 90 according to example embodiments. The acoustic projector system 90 includes an acoustic projector 100 that is driven by a controller 110. The acoustic projector 100 includes a plurality of N acoustic radiators or transducers 102(1) to 102(N) (referred to generically by reference 102(*n*) where 1<=n<=N) that are housed within an enclosure 104. In the illustrated model of FIG. 1, the acoustic transducers 102(*n*) may for example be low cost benders similar to those used in the sonobuoy market; see, for example: John L. Delany, Bender transducer design and operation, J. Acoust. Soc. Am 109(2), February 2001, p. 554-562, the contents of which are hereby incorporated by reference.

In the illustrated model, the transducers 102(*n*) are disc-like devices aligned in spaced apart relation along a common axis within the enclosure 104, and the enclosure 104 is a hard-walled rigid cylindrical tube formed from substantially acoustically impervious material. The enclosure 104 has a first end 108 that is also formed from an acoustic blocking material (i.e., offering a large discontinuity of acoustic impedance tending toward either infinite impedance or pressure release boundary condition), and an acoustically-transparent end region 106 at the opposite end. The configuration of the enclosure 104 is such that acoustic energy is substantially limited to leaving the enclosure 104 through its acoustically-transparent end region 106.

Figure 8:
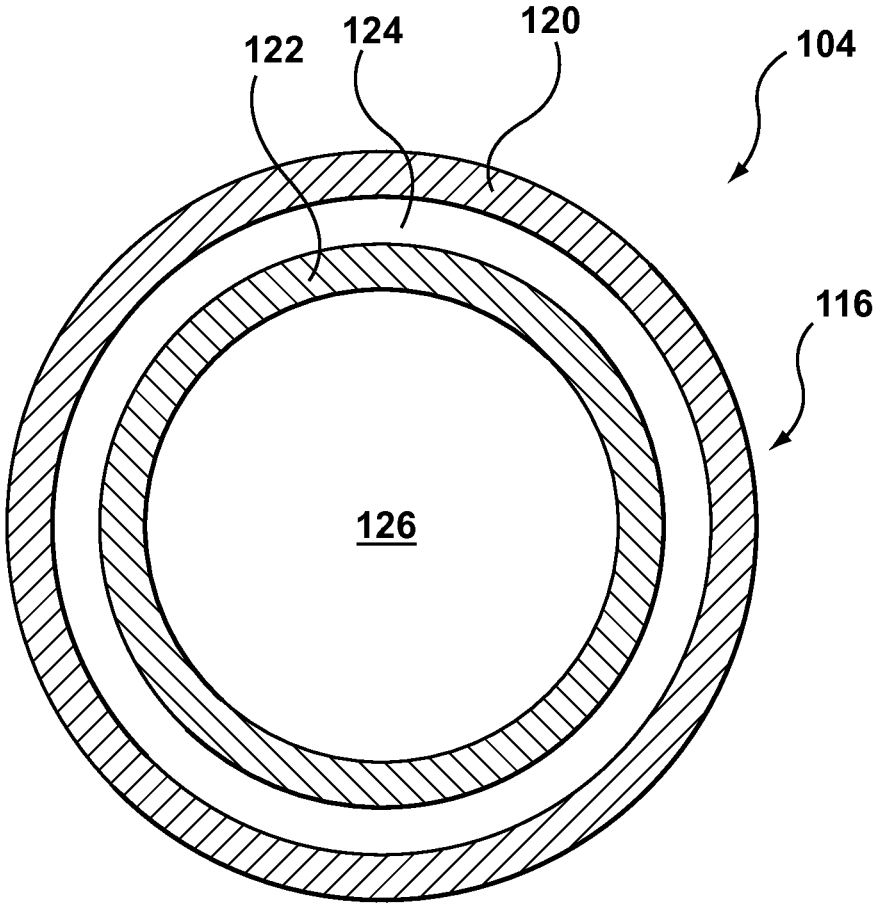
FIG. 8 shows a cross-sectional view of an example enclosure.

Reference is now made to FIG. 8, which shows a cross-sectional view of one example embodiment of the enclosure 104. In this embodiment, the enclosure 104 is formed from an exterior wall 116, and the exterior wall 116 is implemented by two concentric pipes or tubes 120, 122 between which a discontinuity layer 124 is sandwiched. The interior 126 of the interior pipe or tube 122 is space within which the acoustic transducers 102 (FIG. 1) are arranged in series. It will be appreciated that in use the interior 126 includes the acoustic transducers 102 (FIG. 1) surrounded by an acoustically transparent transmission medium, such as air, water, or another substance. In one embodiment, the materials of the tubes 120, 122 and the discontinuity layer 124 are selected such that the exterior wall 116 appears as a (substantially) infinite acoustic impedance (i.e. a substantially-perfect acoustic reflector). In one example embodiments, the tubes 120, 122 are formed using a polyvinyl chloride (PVC) materials and the discontinuity layer 124 is provided by air.

In an example embodiment, the acoustically-transparent end region 106 is an aperture that is smaller than one third of the acoustic wavelength of the intended acoustic output of the acoustic projector 100 in order to create a monopole source. Confining the acoustic transducers 102(*n*) within a rigid enclosure 104 such as a hard-walled tube permits acoustic pressure loading such that the excitation voltages applied to the acoustic transducers 102(*n*) can be synchronized to optimize the acoustic coupling between the acoustic transducers 102(*n*). The radiated power of each individual transducer 102(*n*) is a product of the pressure on the individual transducer that results from all of the transducers and the velocity of the individual transducer. In an example embodiment, the controller 110 is configured to drive the acoustic transducers 102(*n*) with a driving voltage distribution in which the magnitude and phase applied to each transducer 102(*n*) is selected so that the overall power radiated by the acoustic projector 100 through acoustically transparent region 106 is maximized. As will be explained in greater detail below, this is done by applying a combination of weighting and time-delay (e.g. magnitude and phase) to the driving voltages applied to each of the transducers 102(*n*) to generate a strong propagating acoustic wave in the enclosure 104.

An explanation of a model for selecting the optimal magnitude and phase for the driving voltages for each of the transducers 102(*n*) will now be provided according an example embodiment. Referring again to FIG. 1, in the frequency domain, the volume flow $Q_n$ of a particular acoustic transducer 102(*n*) is a function of the driving voltage $V_n$ applied to the transducer 102(*n*) and the acoustic pressure $p(x_n)$ applied to the transducer 102(*n*). The radiated power $W_{rad}$ from acoustically-transparent end region 106 is a function of the acoustic particle velocity v(tube end) at the end region 106 and radiation impedance z(tube end) at the end region 106. The driving voltage distribution set $\{V_n\}$ is selected to optimize radiated power $W_{rad}$.

The acoustic pressure $p(x_n)$ loading a transducer 102(*n*) is generated by the volume flows $\{Q_m\}$ (m=1 to N) from all the acoustic transducers such that:

$$p(x_n) = \sum_{m=1}^{N} Z_{nm}^{Tube} Q_m \tag{1}$$

where $Z_{nm}^{Tube}$ is an N×N acoustic mutual impedance matrix for the transducers 102 (*n*) in the acoustic projector 100. Due the mutual coupling of the transducers, the acoustic mutual impedance matrix $Z_{nm}^{Tube}$ is a fully populated matrix. According to an example embodiment, a Matched Eigenvalue $\lambda_j$ is substituted for the acoustic mutual impedance matrix $Z_{nm}^{Tube}$ to create a set of decoupled transducers. In practice, the matched Eigenvalue $\lambda_j$ is realized by imposing a specific driving voltage distribution set $\{V_n^j\}$ on all transducers 102 ($n$) in such a way that for each transducer 102 ($n$), the acoustic pressure loading the transducer face does not depend on the other transducer volume flow $Q_m$ (where m is not equal to n). Amongst a set of N possible Eigenvalues, a particular Matched Eigenvalue $\lambda_j$ is chosen so that it maximizes the radiated power $W_{rad}$.

Figure 2:
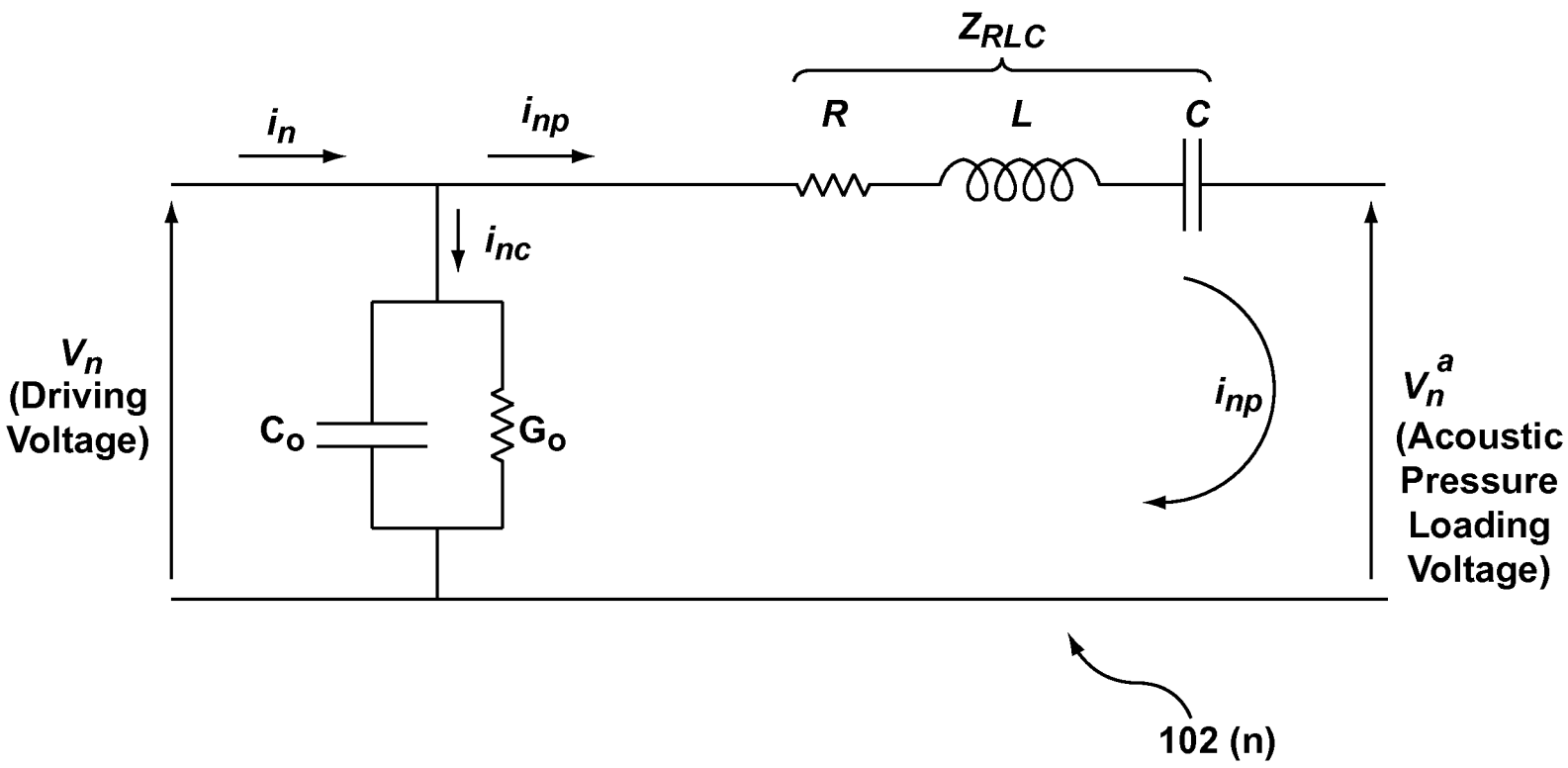
FIG. 2 is an electrical circuit representation of an acoustic transducer of the acoustic projector of FIG. 1 according to an example embodiment.

In this regard, a representative acoustic transducer 102($n$) is illustrated in FIG. 2 as a Van Dyke transducer equivalent circuit, in which capacitor $C_o$ and conductance $G_o$ model the electrical components of the blocked transducer 102($n$) and the resistor R, inductor L and capacitance C model the motional effects of acoustic pressure applied to the acoustic transducer 102($n$). In FIG. 2, $V_n$ is the driving voltage applied to the transducer 102($n$) by controller 110 and $V_n^a$ is the acoustic pressure loading voltage applied to transducer 102($n$) due to mutual coupling of all the acoustic transducers. The acoustic pressure loading voltage $V_n^a$ and resulting current $i_{np}$ will generally be unique for each of the transducers 102($n$) depending on the relative location of the transducer, and in particular can be represented as:

$$V_n^a = \left(\frac{2\sigma}{N_t}\right)p(x_n) \tag{2}$$

$$i_{np} = \left(\frac{N_t}{2\sigma}\right)Q_n \tag{3}$$

where: $2\sigma$ is the transducer face area; and $N_t$ is the electromechanical turns ratio of the ideal transformer of the transducer (using the mechanical/electrical analogy Force→Voltage).

As can be seen from these equations, the current is proportional to the transducer volume flow $Q_n$, and the voltage $V_n^a$ is proportional to the acoustic pressure $p(x_n)$ applied on the transducer 102($n$). Accordingly, the pressure loading voltage $V_n^a$ is a function of the current set $\{i_{mp}\}$ (m=1 to N) circulating in the motional branch of all transducers 102($n$), as illustrated in the following equation:

$$V_n^a = \sum_{m=1}^{N}\left(\frac{2\sigma}{N_t^2}\right)Z_{nm}^{Tube}i_{mp} \tag{4}$$

In the circuit of FIG. 2, the acoustic mutual impedance matrix $Z_{nm}^{Tube}$ can, using the electrical analogy, be electrically represented as electrical mutual impedance matrix $Z_{nm}^a$ as follows:

$$Z_{nm}^a = \left(\frac{2\sigma}{N_t^2}\right)Z_{nm}^{Tube} \tag{5}$$

Substituting Equation (5) into Equation (4), the acoustic pressure loading voltage $V_n^a$ for an acoustic transducer can be represented as:

$$V_n^a = \sum_{m=1}^{N} Z_{nm}^a i_{mp} \tag{6}$$

The radiated acoustic power $W_{rad}$ of the acoustic projector 100 is obtained from pressure loading voltages $V_n^a$ and currents $i_{np}$ in all transducer motional branches, as follows:

$$W_{rad} = \sum_{n=1}^{N}\frac{1}{2}\mathrm{Re}(i_{np}^* V_n^a) \tag{7}$$

where notations Re( ) and * mean "real part of" and "complex conjugate of" respectively.

Substituting equation (6) into equation (7), the acoustic power radiated by the acoustic projector 100 can be represented as:

$$W_{rad} = \frac{1}{2}\mathrm{Re}(\{i_{np}^*\}(Z_{nm}^a)\{imp\}) \tag{8}$$

As appreciated from Equation (8), there will be a set of currents $\{i_{mp}\}$ that maximizes the radiated acoustic power $W_{rad}$. Equation (8) may be evaluated as an Eigenvalue Problem. To find the optimum set of currents, a method based on solving the Eigenvalue Problem of the mutual impedance matrix $Z_{nm}^a$ is used. FIG. 3 mathematically illustrates the relationship between the mutual impedance matrix $Z_{nm}^a$ and the Eigenvalues $\lambda_j$, as expressed by Equation (9) shown therein. Equation (9) illustrates the Eigenvalue Problem of the mutual impedance matrix $Z_{nm}^a$. It will be understood that there are a set of (generally N) eigenvectors $i_{mp}^j$ and corresponding eigenvalues $\lambda_j$ for the mutual impedance matrix $Z_{nm}^a$.

Figure 4A:
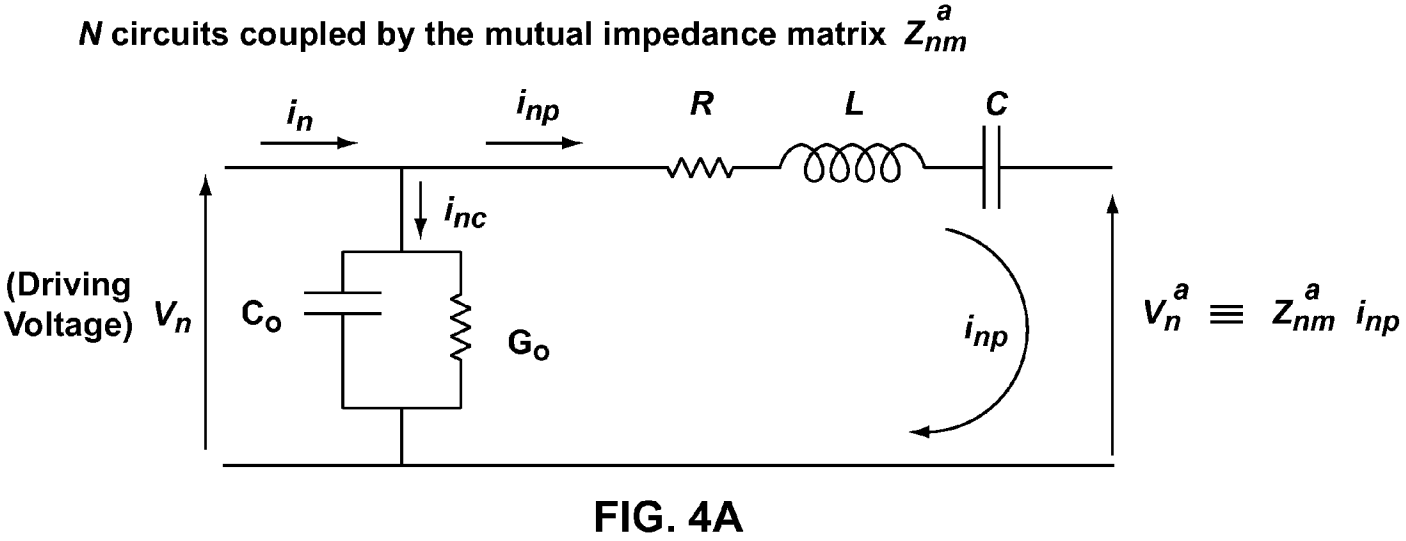
FIGS. 4A and 4B are circuit representations of an acoustic transducer of the acoustic projector of FIG. 1, in which FIG. 4A demonstrates an acoustic transducer coupled by a fully-populated mutual impedance matrix and FIG. 4B demonstrates a decoupled acoustic transducer.
Figure 4B:
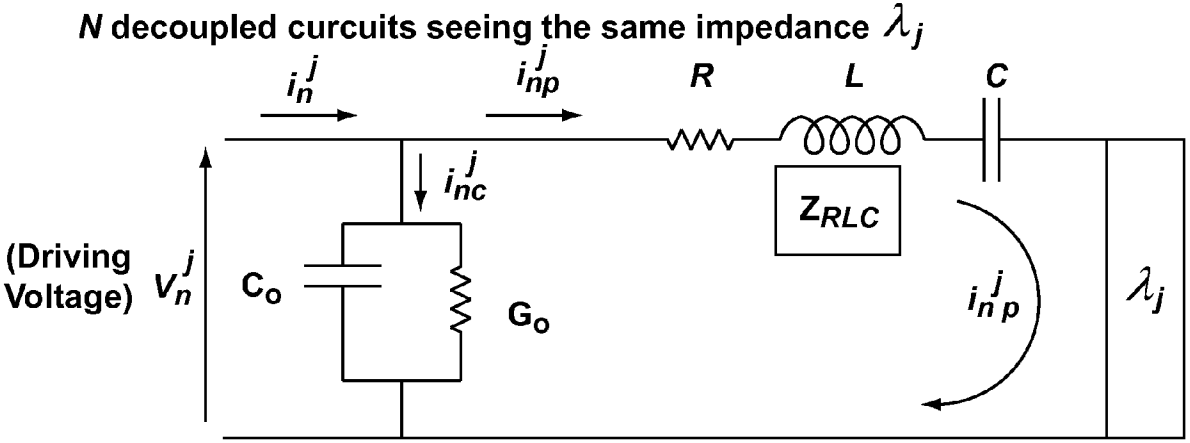

Reference is now made to FIGS. 4A and 4B. As shown in FIG. 4A, N transducer circuits that are initially coupled by the mutual impedance matrix $Z_{nm}^a$ can be turned into N decoupled circuits that each see the same impedance $\lambda_j$, provided that a particular set of motional branch currents $\{i_{np}^j\}$ is imposed which corresponds to the Eigenvector associated with the Eigenvalue $\lambda_j$ as illustrated in the circuit diagram of FIG. 4B.

In practice, the set of currents $\{i_{np}^j\}$ is indirectly imposed by the controller 110 which generates a set of driving voltages $\{V_n^j\}$ defined by (FIG. 4B):

$$V_n^j = (Z_{RLC} + \lambda_j) i_{np}^j \tag{10}$$

The acoustic power radiated by the acoustic projector 100 is then given by:

$$W_{rad}^j = \frac{1}{2}\sum_{n=1}^{N}\frac{\mathrm{Re}(\lambda_j)}{\|Z_{RLC} + \lambda_j\|^2}\|V_n^j\|^2 \tag{11}$$

In order to maximize system radiated power, amongst N possible Eigenvalues, a Matched Eigenvalue $\lambda_j$ is picked which maximizes the expression of $W_{rad}^j$ in Equation (11). That is, the Matched Eigenvalue $\lambda_j$ is selected on the basis that it best matches $Z_{RLC}^*$.

In the description herein the indices n and m are used to track the transducers and these indices both range from 1 to N. In some cases, both indices are used to track the impact on the n-th transducer of parameters (such as current) from all m (m=1 . . . N) transducers. Equation (6) is one example. Accordingly, the notation $i_{mp}$ and $i_{np}$ is used somewhat interchangeably in the description herein to refer to the currents associated with the transducers. It will be appreciated that references to the eigenvectors or the motional currents herein may use the notation $i_{mp}$ or $i_{np}$ (or $i_{np}^j$ or $i_{mp}^j$, in the case of the eigenvectors).

In some example embodiments, the acoustic projector system 90 could include a calibrating subsystem able to estimate on the fly the mutual impedance matrix by driving one transducer at a time while monitoring all driving voltages $V_n$ and currents $i_n$ for the transducers and using the circuit models shown in FIGS. 4A and 4B.

The controller 110 could, for example, include a microprocessor system (including for example, a microprocessor, electronic storage, and I/O interfaces) configured to implement power maximization processes described herein. The microprocessor system could be embedded in or mounted to the enclosure 104, for example. In another embodiment, the microprocessor system may be implemented on a special purpose or general purpose computing system onboard a marine vessel or other vehicle to which the acoustic projector system 90 is mounted or from which it is towed or otherwise deployed. The marine vessel or other vehicle may supply the power to drive the acoustic projector system 90, such as the electrical energy used to drive the transducers as controlled by the controller 110.

Figure 9:
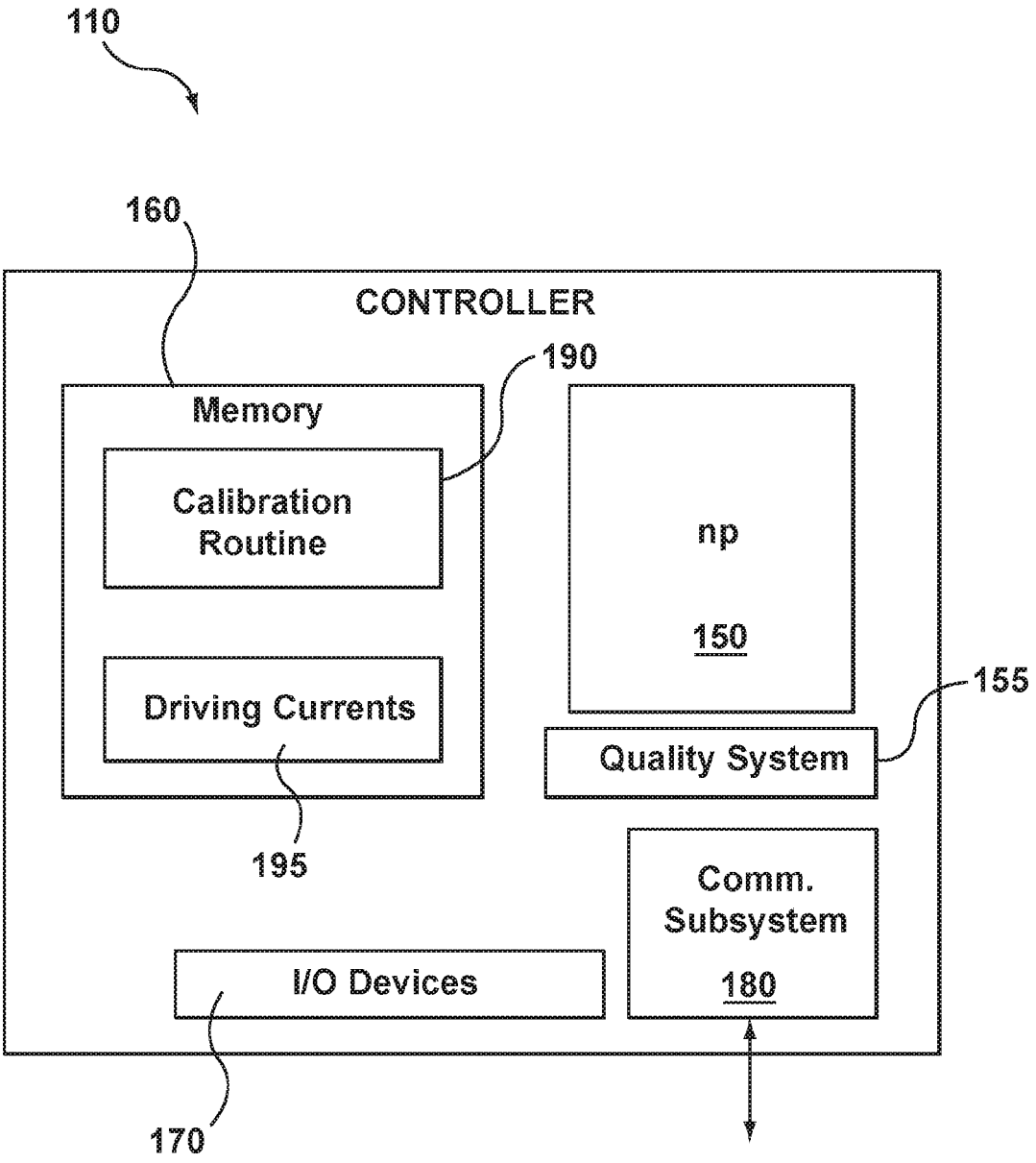
FIG. 9 shows a block diagram of an example controller for an acoustic projector.

Reference is now made to FIG. 9, which shows a block diagram of an example controller 110. The controller 110 includes a microprocessor 150, memory 160, input/output devices 170, and a communications subsystem 180. The microprocessor 150 may operate under stored program control and may execute or run various software routines or applications. In some embodiments, the controller 110 may include an operating system 155, which controls basic controller 110 functions and provides a platform within which other applications or routines may be executed. The operating system 155 may be stored in the memory 160 or in other memory in the controller 110.

The memory 160 may store various applications which, when executed by the microprocessor 150, implement various functions or operations. In one example, the memory 160 includes a calibration routine 190. The calibration routine 190 implements the calibrations functions describe herein for determining the characteristics of an array of transducers and for determining the driving currents that maximize radiated power of the acoustic array.

The memory 160 may also store data, such one or more sets of predetermined driving currents 195 each associated with particular operating characteristics.

The controller 110 may also include a driving circuit (not shown) for generating the driving currents for the transducers, in some embodiments. In other embodiments, the driving circuit may be implemented separately but may operate under control of the controller 110, such as through various control/switching signals.

Figure 5:
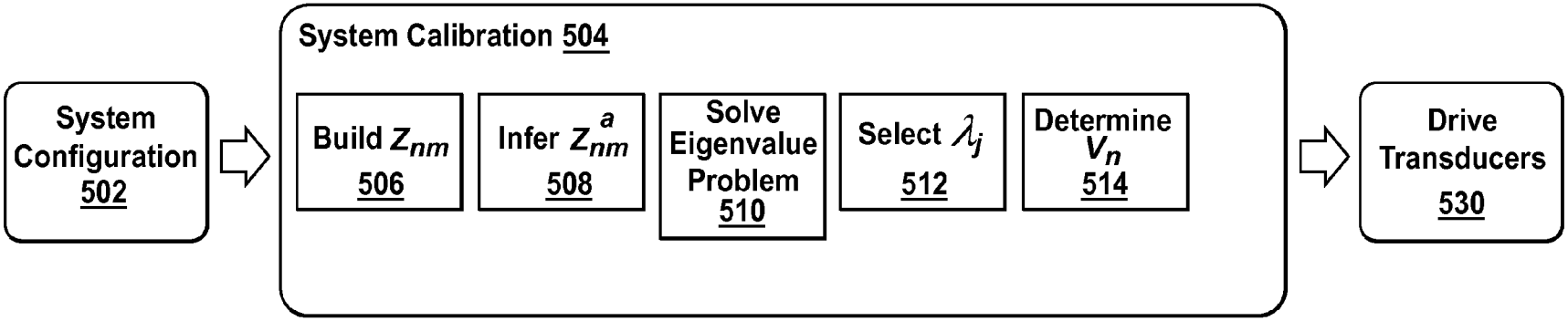
FIG. 5 is a process implemented by the acoustic projector system of FIG. 1 according to an example embodiment.

Reference is now made to FIG. 5, which shows a flow chart representation of one possible example of a process 500 implemented by the controller 110 to implement the methodology described above. Prior to use, the controller 110 is preconfigured during a system configuration action 502 with the operating parameters for the acoustic projector 100 such as N (the number of transducers) and values for the parameters of each of the transducers 102(*n*) including transducer capacitance $C_o$, conductance $G_o$ as well as resistance R, inductance L and capacitance $C(Z_{rlc})$, and other system values such as N (number of transducers). In some instances, the controller 110 may be re-configurable, for example if the acoustic projector 100 is changed from time-to-time, such that the system configuration action 502 is re-performed at the option of the operator if a change is made to the characteristics of the acoustic projector 100, whether prior to deployment or during deployment of the acoustic projector 100 in an operating environment.

Once the acoustic projector 100 is placed in its operating environment, a series of system calibration actions 504 may be performed, including building an intermediate mutual impedance matrix $Z_{nm}$ by sending a calibration tone to each transducer 102(*n*) individually one at a time and measuring the resulting voltage $V_n$ and current $i_n$ at each of the other transducers 102(*n*). As indicated at action 508, as the values of resistance R, inductance L and capacitance C are known, the electrical mutual impedance matrix $Z_{nm}{}^a$ can then be inferred from matrix $Z_{nm}$. As indicated at action 510, once the electrical mutual impedance matrix $Z_{nm}{}^a$ is known, the Eigenvalue Problem of the mutual impedance matrix $Z_{nm}{}^a$ is solved to provide a set of N Eigenvalues $\lambda_j$. As indicated at action 512, from among the N Eigenvalues $\lambda_j$, a Matched Eigenvalues $\lambda_j$ is selected that allows the radiated power from the acoustic projector to be maximized. The selected Matched Eigenvalue $\lambda_j$ will have a corresponding eigenvector $\{i_{np}{}^j\}$ from which the current $i_{np}$ required for each transducer 102(*n*) to achieve the desired impedance $\lambda_j$ can be determined. As indicated in action 512, the set of driving voltages $\{V_n{}^j\}$ can then be determined as the electrical parameters of the transducers 102(*n*) are known.

As indicated by action 520, after the completion of system calibration actions 504, the transducers 102(*n*) can be driven with the set of driving voltages $\{V_n{}^j\}$. The system calibration actions 504 may be done at predetermined intervals during operation of the acoustic projector 100 to mitigate against drift and account for changing acoustic conditions in the operating environment.

In some example embodiments, rather than performing all of the system calibration actions 504 during actual system operation, the controller 110 could be preconfigured with data sets that have been predetermined using actions 504 based on different operating conditions (for example, different acoustic velocities), and the corresponding data set selected based on the present operation conditions at the time of operation. For example, using system calibrations actions 504, sets of driving voltages $\{V_n{}^j\}$ could be predetermined for the acoustic projector 100 for different acoustic velocities in the operating medium. In operation, the acoustic velocity of the environment in which the acoustic projector is located can be measured and then the appropriate set of driving voltages $\{V_n{}^j\}$ selected based on the measured acoustic velocity.

Figure 6:
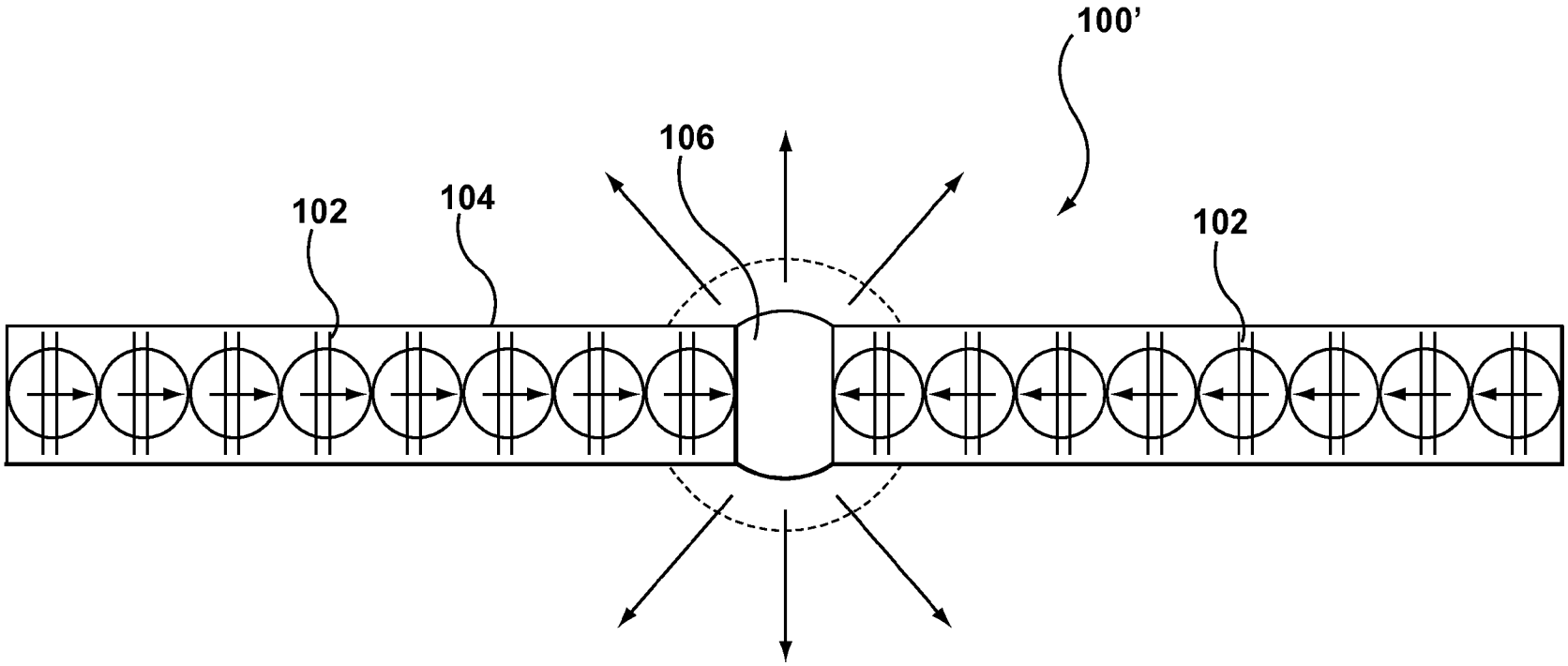
FIG. 6 is a schematic representation of an omnidirectional acoustic projector system according to a further example embodiment.

In some example embodiments, the acoustically transparent region 106 from which omnidirectional acoustic energy radiates could be located at somewhere other than the end of the enclosure 104. In this regard, FIG. 6 illustrates another example of an acoustic projector 100' which is similar in function to acoustic projector 100 except that the enclosure 104 in FIG. 6 has sealed end regions with acoustically transparent region 106 being located at the center of the enclosure 104. It will be appreciated that the enclosure 104 is a pipe or tube in this example. The transducers 102 in the right side of the enclosure 104 are aligned to radiate towards the central acoustically transparent region 106, and similarly, the transducers 102 in the left side of the enclosure 104 are aligned to radiate towards the central acoustically transparent region 106.

Figure 7:
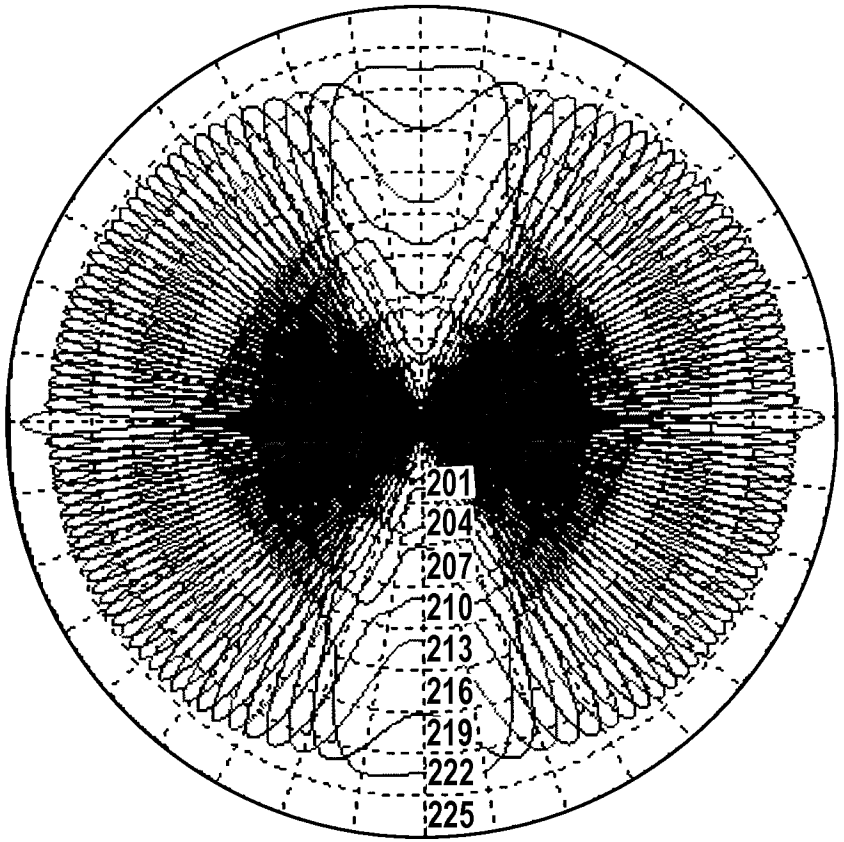
FIG. 7 is an example of an optimal projector array transmit beam set generated by the proposed power maximization system.

Although the above described embodiments have focused on transducers that are aligned within a rigid, acoustically-impervious enclosure having a transmitting region for generating an omnidirectional acoustic wave, in other example embodiments the methods described above can be adapted to acoustic transducers that are aligned within an acoustically transparent enclosure like those of a towed HPA (horizontal projector array). In this last embodiment the projector antenna is longer than a wavelength and therefore, omni-directionality is not guaranteed. However, the described Eigenvalue-based power maximization algorithm still provides the optimum voltage distribution required to maximize system radiation power. The algorithm provides a set of optimum beampatterns able to radiate efficiently and cover a 360 degree sector. One example of such a beam set is illustrated in FIG. 7.

The acoustic projectors described above could be used in a system requiring a stationary acoustic projector—for example at a bottom of a sea bed, or could be adapted for use in a towed system, among other applications.

The presented Power Maximization method is applicable to many systems using transducer arrays like medical imaging and, more generally, structural health monitoring devices. The method also apply to electromagnetic antennas and may be applied to RF communications towers, RADAR, magneto-inductive communication and wireless powering systems, and more generally to any system involving multichannel inputs and/or outputs.

ILLUSTRATIVE EXAMPLES

Various examples are now presented that illustrate application of the above described calibration and control process to one or modeled embodiments of an acoustic projector.

Figure 10:
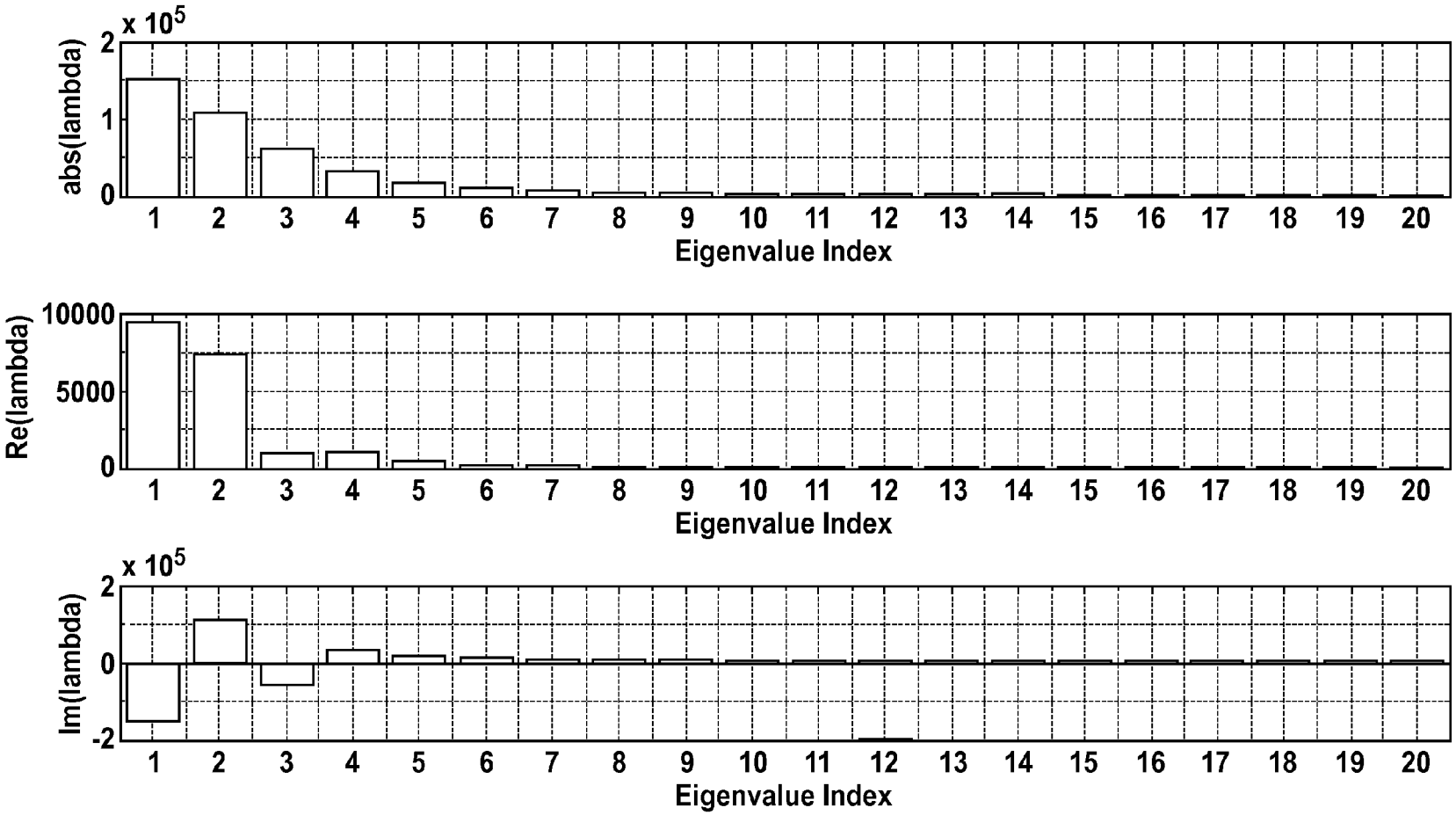
FIGS. 10 to 15 show charts of parameters determined by the model based upon application of the process to a first example.

In a first example, the acoustic projector includes 20 acoustic transducers, an overall length of 2 meters, and a diameter of 0.12 meters. The mean driving voltage over all transducers is 1200 $V_{rms}$. FIG. 10 shows sample charts illustrating the model output of 20 eigenvalues (abs, real, and imaginary components).

Figure 11:
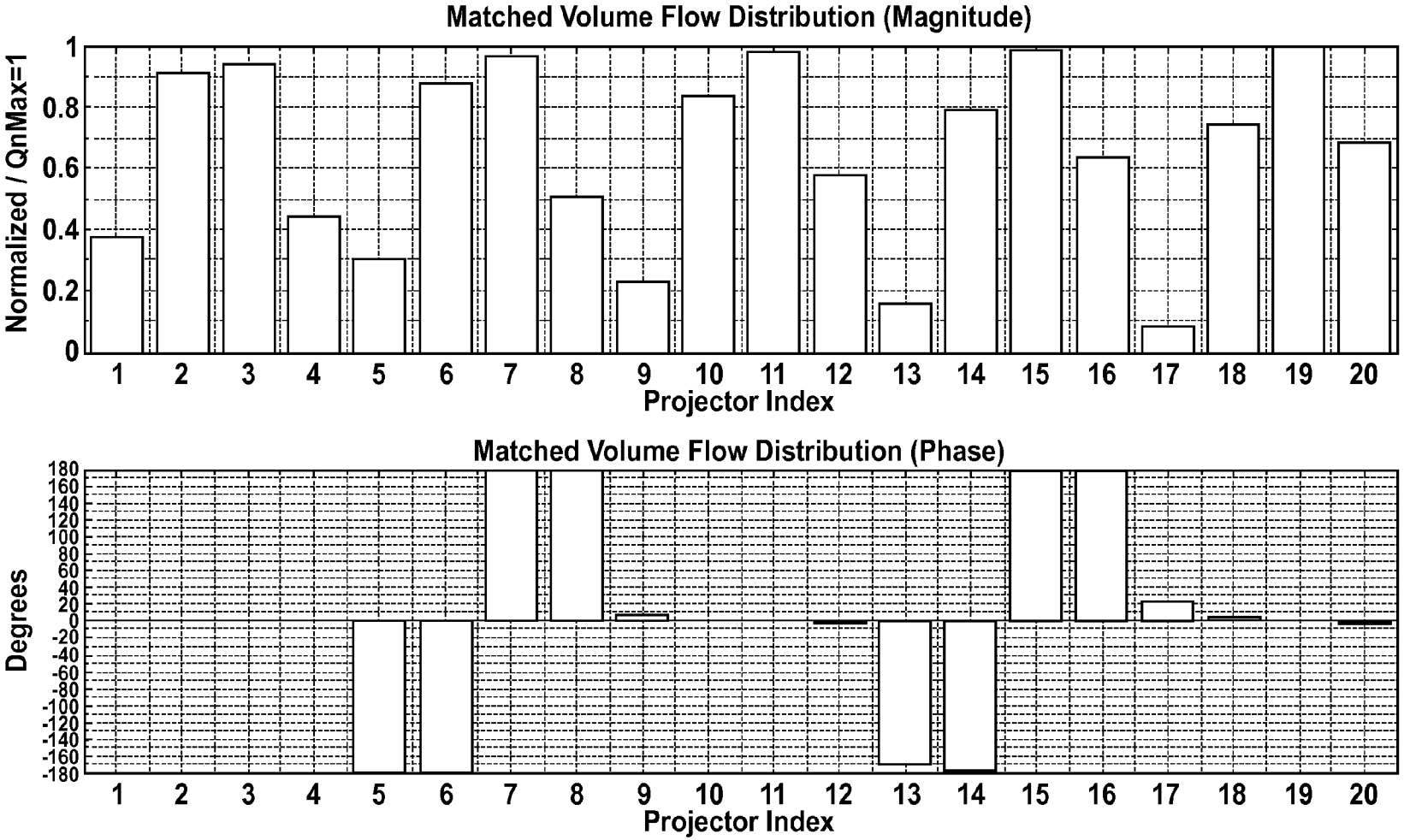
Figure 12:
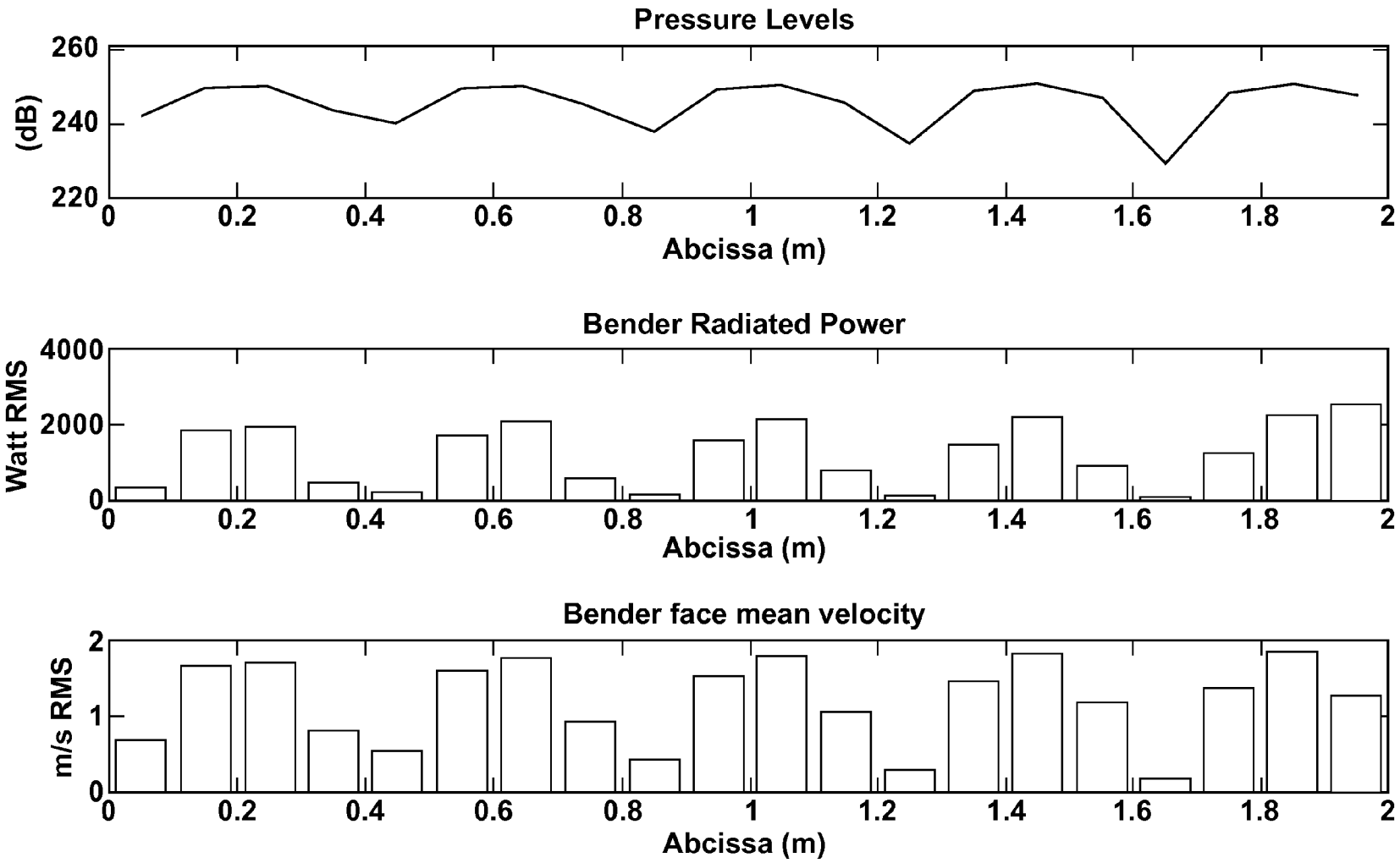
Figure 13:
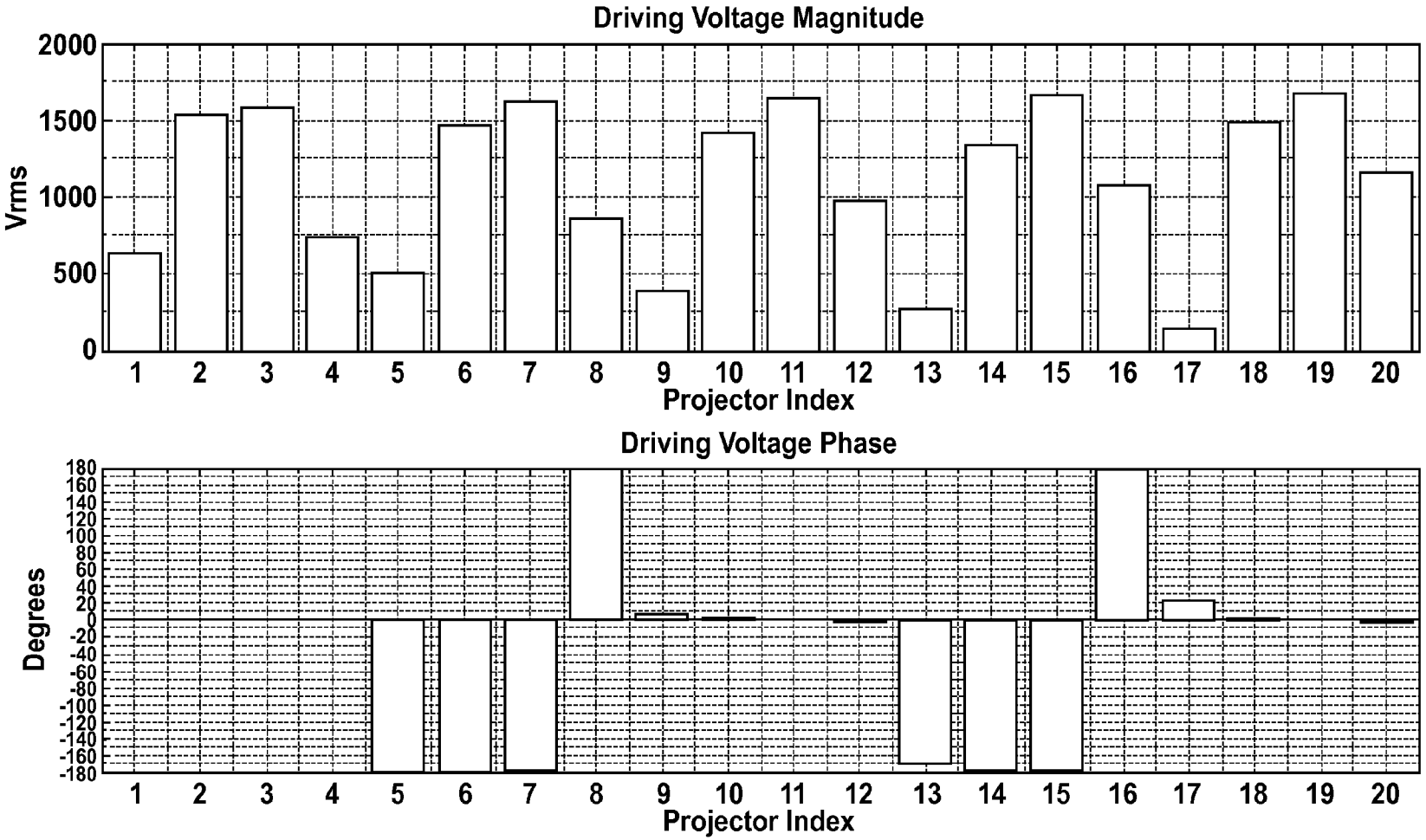
Figure 14:
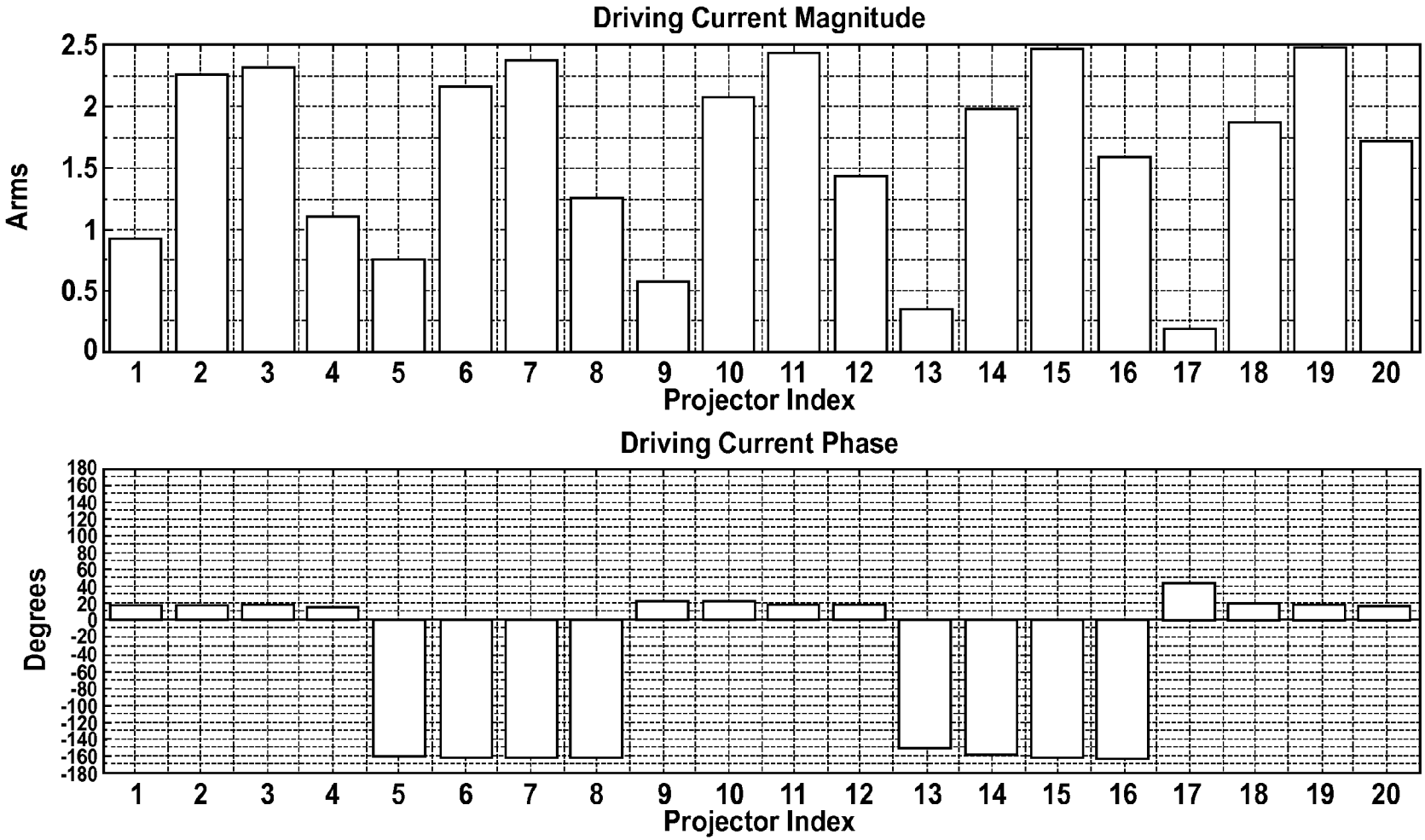
Figure 15:
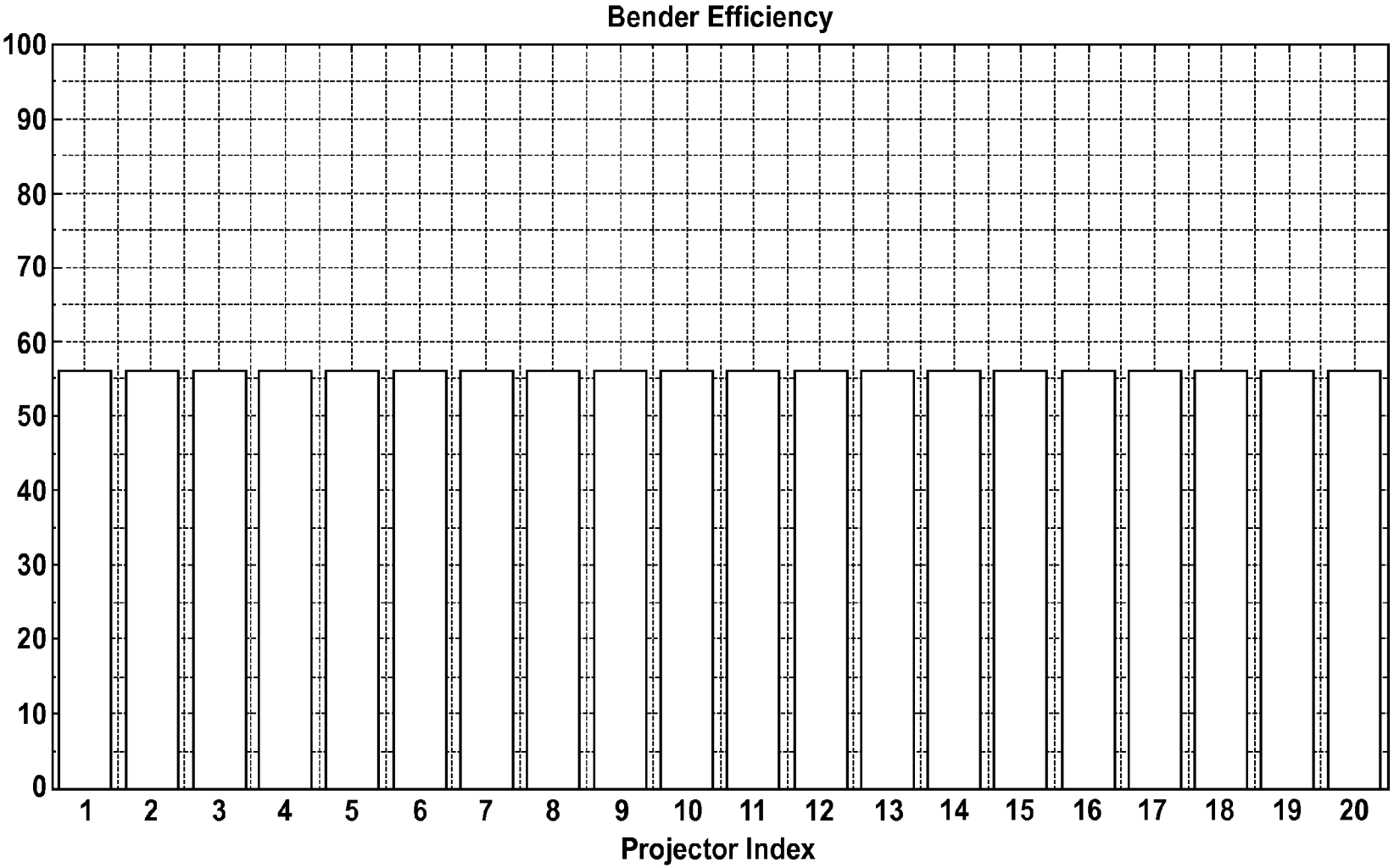

Using 900 Hz as a driving frequency, the volume flow distribution is charted in the charts shown in FIG. 11. FIG. 12 shows the pressure level, radiated power and face velocity. FIG. 13 shows the driving voltage magnitude and driving voltage phase. The corresponding driving currents are shown in FIG. 14. The transducer radiation efficiency is shown in FIG. 15.

Figure 16:
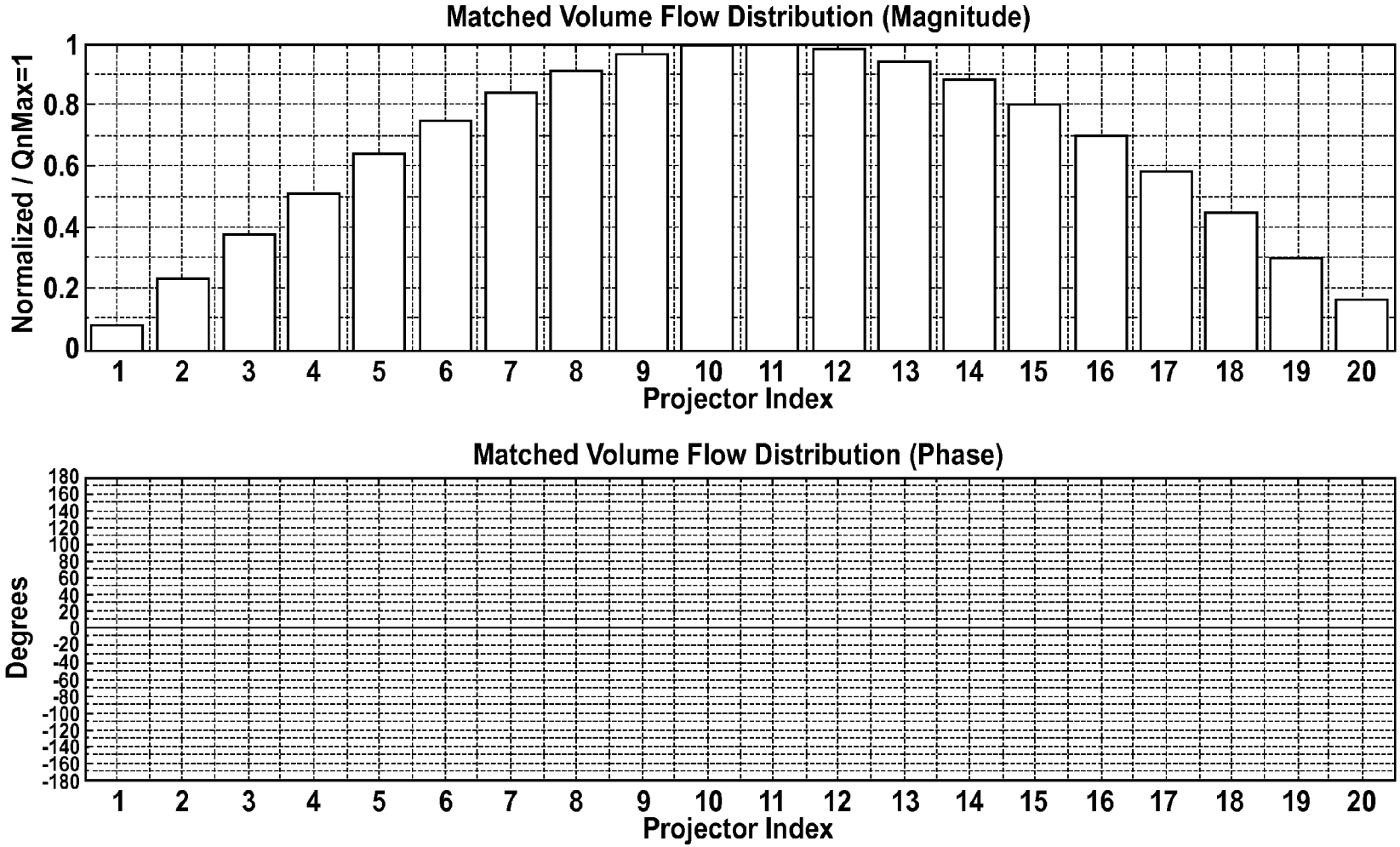
FIGS. 16 to 20 show charts of parameters determined by the model based upon application of the process to a second example.
Figure 17:
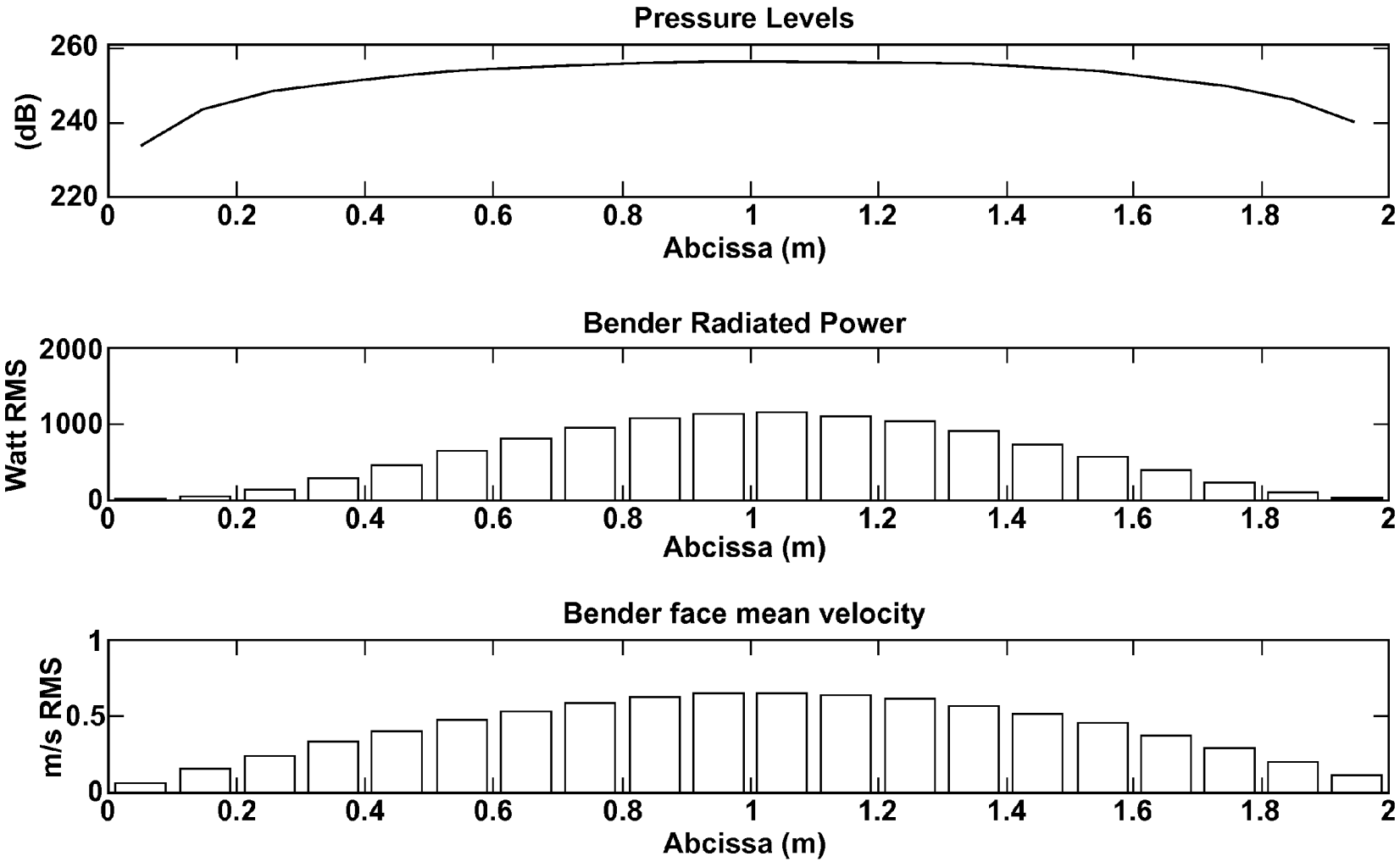
Figure 18:
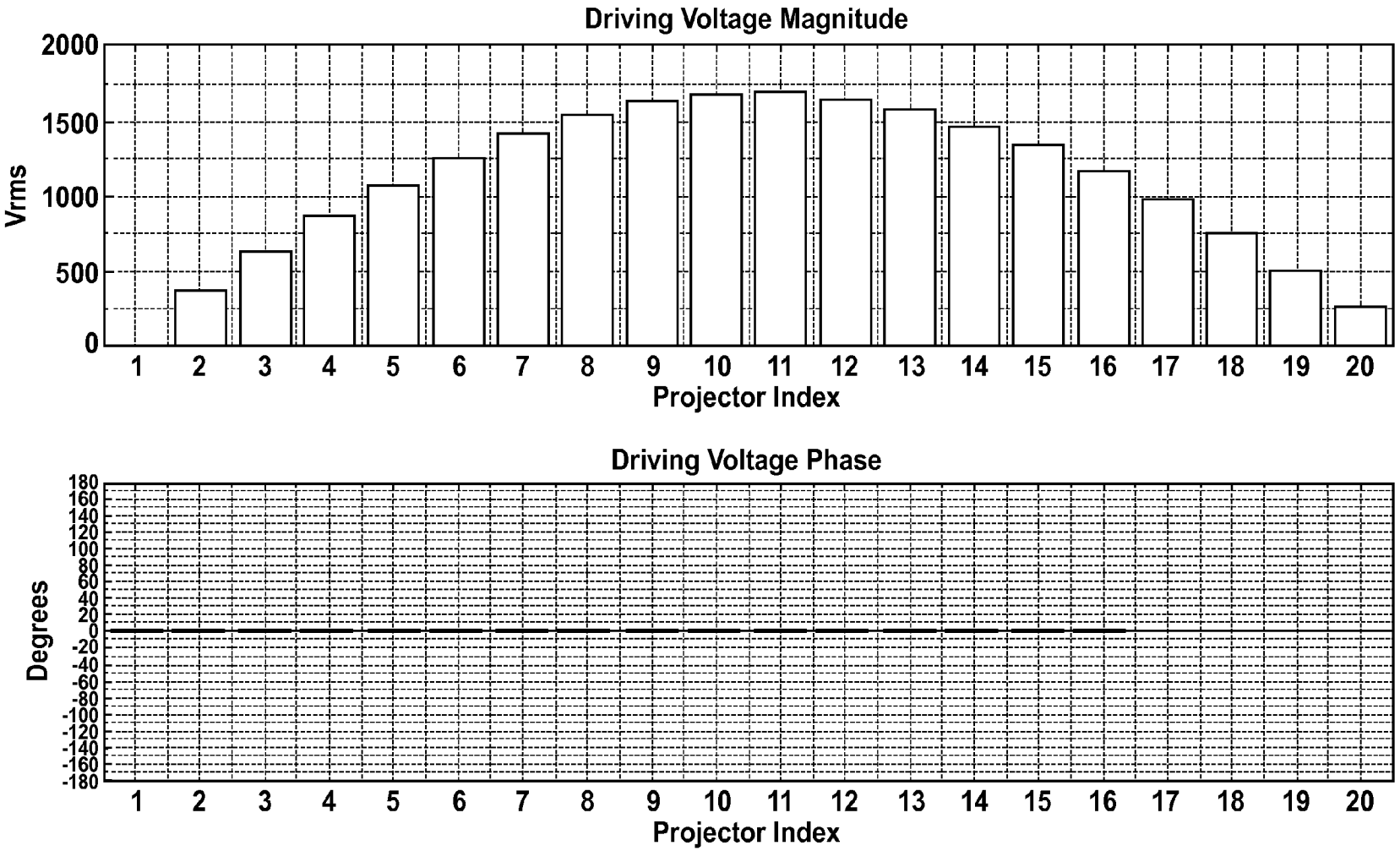
Figure 19:
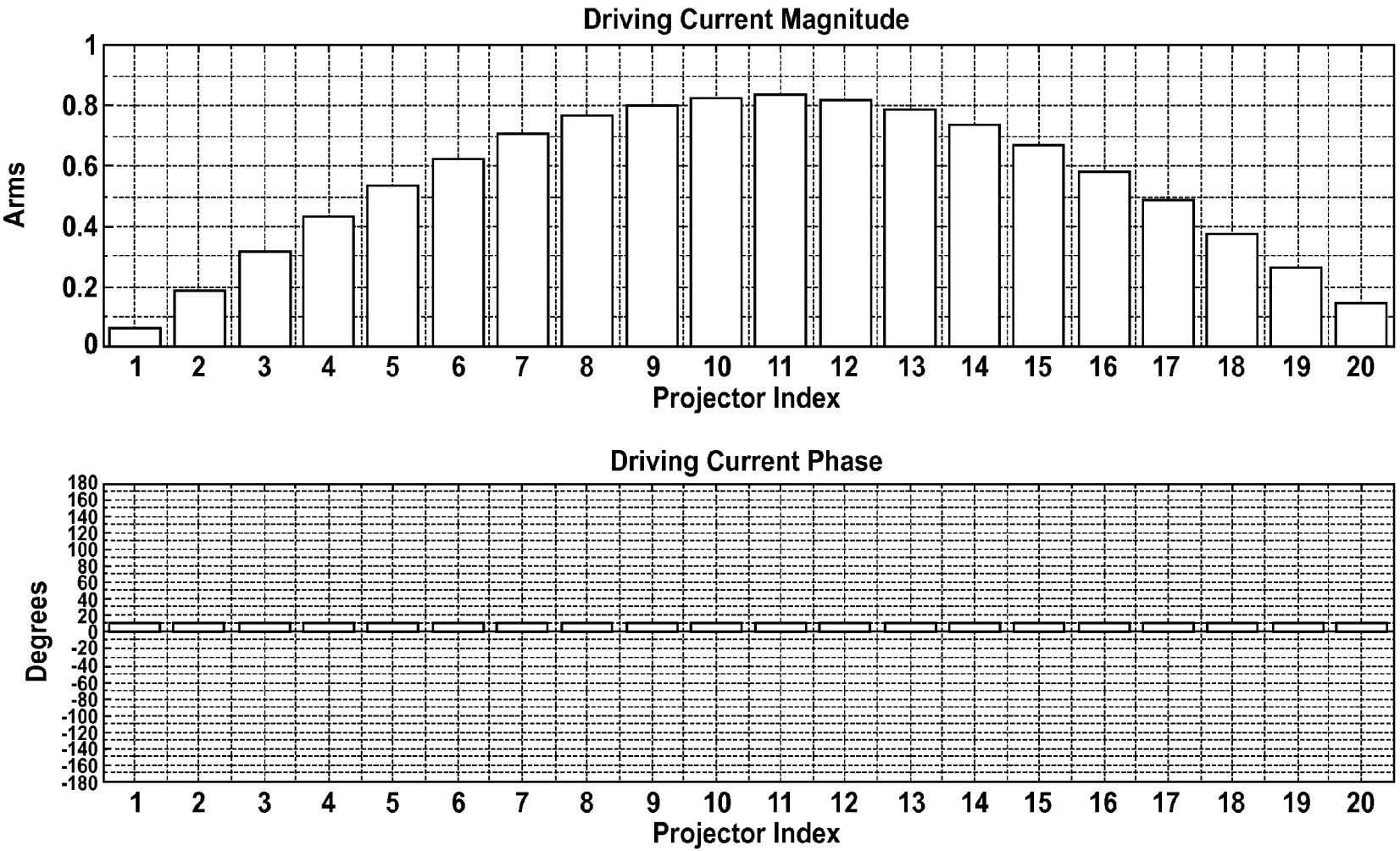
Figure 20:
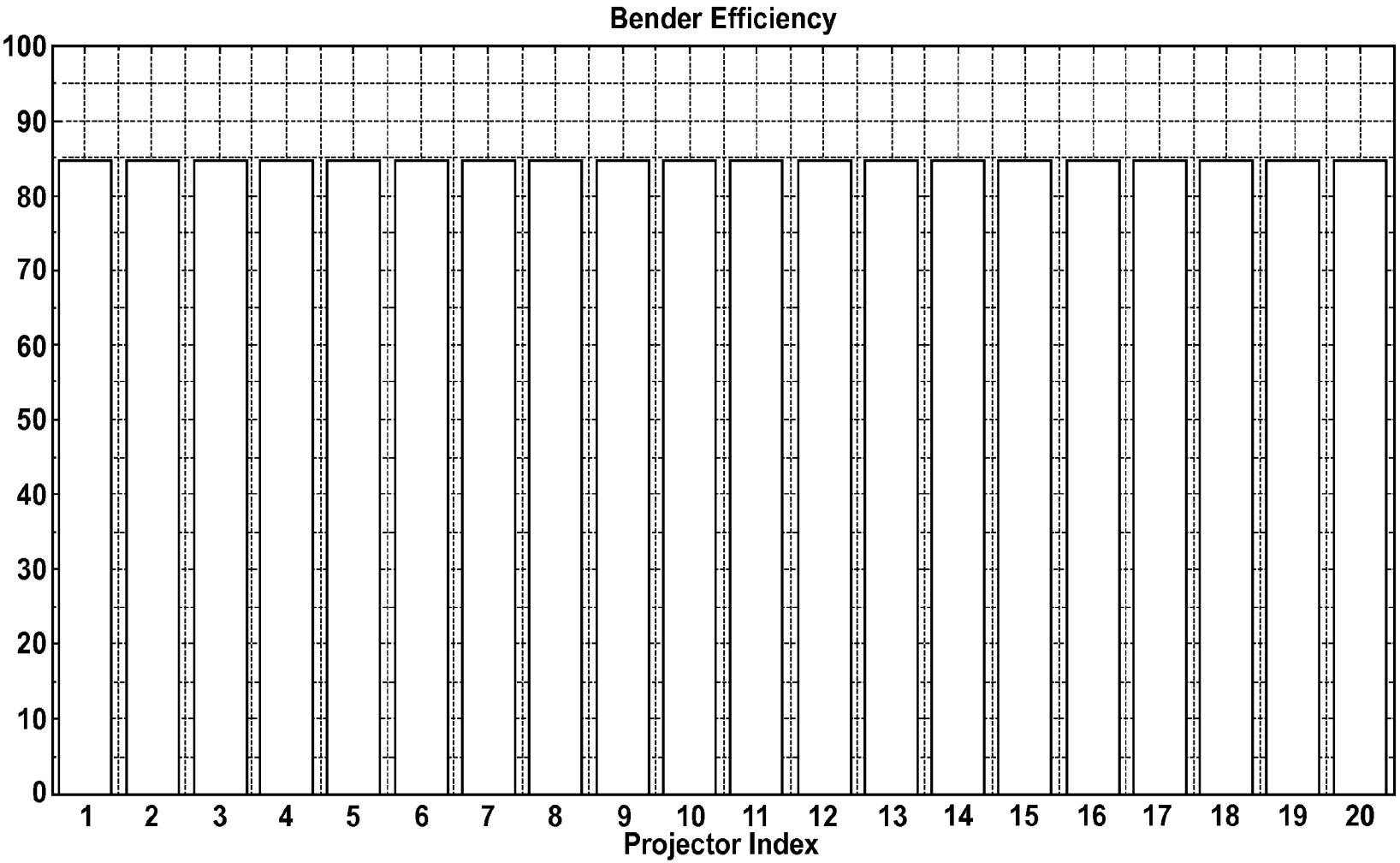

Using 190 Hz as a driving frequency, the volume flow distribution is charted in the charts shown in FIG. 16. FIG. 17 shows the pressure level, radiated power and face velocity. FIG. 18 shows the driving voltage magnitude and driving voltage phase, and the corresponding driving currents are shown in FIG. 19. The transducer radiation efficiency is shown in FIG. 20.

The various embodiments presented above are merely examples and are in no way meant to limit the scope of this disclosure. Variations of the innovations described herein will be apparent to persons of reasonable skill in the art, such variations being within the intended scope of the present application. In particular, features from one or more of the above-mentioned embodiments may be selected to create alternative embodiments comprising a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter herein and in the recited claims intends to cover and embrace all suitable changes in technology.

Certain adaptations and modifications of the described embodiments can be made. Therefore, the above discussed embodiments are considered to be illustrative and not restrictive.

What is claimed is:

1. An acoustic projector with an operating frequency having a minimum wavelength under operating conditions, comprising:

an enclosure formed from a substantially acoustically-impervious exterior wall, wherein the exterior wall defines an acoustically transparent aperture smaller than one-third the minimum wavelength;

an array of acoustic transducers within the enclosure;

a drive circuit for driving each acoustic transducer in the array with a respective drive signal; and a controller to determine the respective drive signals, wherein the controller includes a calibration routine which, when executed, determines a mutual impedance matrix that characterizes the mutual coupling among the acoustic transducers, solves an eigenvalue problem of the mutual impedance matrix to identify a set of eigenvalues, selects one of the eigenvalues that maximizes an expression for radiated power, and determines the respective driving signals from the selected one of the eigenvalues.

2. The acoustic projector claimed in claim 1, wherein the selected one of the eigenvalues corresponds to a best match to an estimated drive circuit impedance for each of the acoustic transducers.

3. The acoustic projector claimed in claim 1, wherein the calibration routine determines a mutual impedance matrix by, serially, sending a calibration tone to each transducer and measuring voltage and current at each other transducer resulting from the calibration tone.

4. The acoustic projector claimed in claim 1, wherein the calibration routine is to solve the eigenvalue problem expressed as:

$$\{i_{np}^{*j}\}(Z_{nm}^{a})(i_{mp}^{j})=\lambda_j\{i_{mp}^{*j}\}(i_{mp}^{j})=\lambda_j$$

where $\lambda_j$ comprise the eigenvalues, $i_{np}^{j}$ comprise the eigenvectors, and $Z_{nm}^{a}$ comprises the mutual impedance matrix.

5. The acoustic projector claimed in claim 1, wherein there are N transducers in the array, wherein the expression for radiated power is given by:

$$W_{rad}^{j}=\frac{1}{2}\sum_{n=1}^{N}\frac{\mathrm{Re}(\lambda_j)}{\|Z_{RLC}+\lambda_j\|^2}\|V_n^j\|^2$$

and wherein $W_{rad}^{j}$ comprises radiated power, $\lambda_j$ comprise the eigenvalues, $V_n^j$ comprises driving voltages, and $Z_{RLC}$ comprises a circuit impedance for the drive circuit.

6. The acoustic projector claimed in claim 1, wherein the calibration routine is further to first determine system parameters including a circuit impedance for the drive circuit.

7. The acoustic projector claimed in claim 1, wherein the substantially acoustically-impervious exterior wall comprises two concentric hard-walled tubes between which is sandwiched a discontinuity layer.

8. The acoustic projector claimed in claim 7, wherein the substantially acoustically-impervious exterior wall includes one closed end and one open end, and wherein the open end defines the aperture.

9. The acoustic projector claimed in claim 7, wherein the substantially acoustically-impervious exterior wall includes two closed ends and wherein the aperture is located in the exterior wall at a position between the two ends.

10. A method for controlling an acoustic projector, the acoustic projector including an array of acoustic transducers, the method comprising:

determining a mutual impedance matrix that characterizes the mutual coupling among the acoustic transducers;

identifying a set of eigenvalues that solve an eigenvalue problem of the mutual impedance matrix;

selecting one of the eigenvalues that maximizes an expression for radiated power; and determining, from the selected one of the eigenvalues, respective driving signals for driving each of the acoustic transducers.

11. The method claimed in claim 10, wherein the selected one of the eigenvalues corresponds to a best match to an estimated drive circuit impedance for each of the acoustic transducers.

12. The method claimed in claim 10, wherein determining the mutual impedance matrix comprises serially sending a calibration tone to each acoustic transducer and measuring voltage and current at each other transducer resulting from the calibration tone.

13. The method claimed in claim 12, wherein the eigenvalue problem is expressed as:

$$\{i_{np}^{*j}\}(Z_{nm}^{a})(i_{mp}^{j})=\lambda_j\{i_{mp}^{*j}\}(i_{mp}^{j})=\lambda_j$$

where $\lambda_j$ comprise the eigenvalues, $i_{np}^{j}$ comprise the eigenvectors, and $Z_{nm}^{a}$ comprises the mutual impedance matrix.

14. The method claimed in claim 10, wherein there are N transducers in the array, wherein the expression for radiated power is given by:

$$W_{rad}^{j}=\frac{1}{2}\sum_{n=1}^{N}\frac{\mathrm{Re}(\lambda_j)}{\|Z_{RLC}+\lambda_j\|^2}\|V_n^j\|^2$$

and wherein $W_{rad}^{j}$ comprises radiated power, $\lambda_j$ comprises the eigenvalues, comprises $V_n^j$ driving voltages, and $Z_{RLC}$ comprises an estimated circuit impedance.

15. The method claimed in claim 10, further comprising first determining system parameters including an estimated circuit impedance for a drive circuit for driving each of the acoustic transducers.

16. A non-transitory computer-readable storage disc or storage device comprising instructions that, when executed, cause a processor to at least:

determine a mutual impedance matrix that characterizes mutual coupling among acoustic transducers;

identify a set of eigenvalues that solve an eigenvalue problem of the mutual impedance matrix;

select one of the eigenvalues that maximizes an expression for radiated power; and determine, from the selected one of the eigenvalues, respective driving signals for driving each of the acoustic transducers.

17. The non-transitory computer-readable storage disc or storage device claimed in claim 16, wherein the selected one of the eigenvalues corresponds to a best match to an estimated drive circuit impedance for each of the acoustic transducers.

18. The non-transitory computer-readable storage disc or storage device claimed in claim 16, wherein the instructions, when executed, cause the processor to determine the mutual impedance matrix by serially sending a calibration tone to each acoustic transducer and measuring voltage and current at each other transducer resulting from the calibration tone.

* * * * *